US009531097B2

(12) United States Patent
Chen

(10) Patent No.: US 9,531,097 B2
(45) Date of Patent: Dec. 27, 2016

(54) ELECTRICAL CONNECTOR

(71) Applicant: LOTES CO., LTD, Keelung (TW)

(72) Inventor: Zhi Lin Chen, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/825,960

(22) Filed: Aug. 13, 2015

(65) Prior Publication Data

US 2016/0156143 A1 Jun. 2, 2016

(30) Foreign Application Priority Data

Dec. 2, 2014 (CN) ..... 2014 2 0739982 U

(51) Int. Cl.

*H01R 24/00* (2011.01)
*H01R 12/87* (2011.01)
*H01R 12/72* (2011.01)
*H01R 12/79* (2011.01)

(52) U.S. Cl.

CPC ..... *H01R 12/87* (2013.01); *H01R 12/724* (2013.01); *H01R 12/79* (2013.01)

(58) Field of Classification Search

CPC ..... H01R 12/87; H01R 12/724; H01R 12/79; H01R 13/443; H01R 13/658; H01R 13/42; H01R 13/05; H01R 13/516; H01R 24/60; H01R 13/0501; H01R 13/665; H01R 13/6582; G02B 6/3817

USPC ..... 439/676

See application file for complete search history.

(56) References Cited

U.S. PATENT DOCUMENTS 6,113,428 A * 9/2000 Yeh ..... H01R 13/65802 439/607.17
7,081,017 B2 * 7/2006 Shuey ..... H01R 13/65802 439/607.23
8,033,853 B2 * 10/2011 Chang ..... H01R 13/6275 439/304
8,465,299 B2 * 6/2013 Ho ..... H01R 13/506 439/607.05
8,506,317 B2 * 8/2013 Lim ..... H01R 9/032 439/345
8,684,752 B2 * 4/2014 Hsueh ..... H01R 12/721 439/79
2011/0268396 A1 * 11/2011 He ..... G02B 6/3817 385/93
2012/0009822 A1 * 1/2012 Ho ..... H01R 13/516 439/626

(Continued)

*Primary Examiner* — Jean F Duverne

(74) *Attorney, Agent, or Firm* — Locke Lord LLP; Tim Tingkang Xia, Esq.

(57) ABSTRACT

An electrical connector for mating with a mating connector includes an insulating body and multiple terminals. The insulating body has a base, a tongue protruding forward from the base, and multiple terminal slots run from the tongue backward and through the base. The terminals are disposed in the terminal slots respectively. Each of the terminals has a retaining portion retained at the base, a contact portion extending forward from one end of the retaining portion to the tongue, and an urging portion disposed between the retaining portion and the contact portion. The urging portion is higher than an upper surface of the tongue. When the electrical connector mates with the mating connector, the mating connector presses against the urging portion downward, such that the contact portion electrically contacts the mating connector.

15 Claims, 7 Drawing Sheets

(56) References Cited

U.S. PATENT DOCUMENTS

2015/0244098 A1* 8/2015 Ma ..... H01R 24/60
439/660
2016/0093970 A1* 3/2016 Wu ..... H01R 13/443
439/148

* cited by examiner

100

200

ELECTRICAL CONNECTOR

CROSS-REFERENCE TO RELATED APPLICATION

This non-provisional application claims priority under 35 U.S.C. §119(a) on Patent Application No. 201420739982.1 filed in P.R. China on Dec. 2, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and particularly to an electrical connector that effectively reduces signal transmission loss.

BACKGROUND OF THE INVENTION

An electrical connector in the prior art (as shown in FIG. 7) includes a body 9. The body 9 has a base 91 and a tongue 92 protruding forward from the base 91. A conducting terminal 10 is disposed in the body 9. The conducting terminal 10 includes a retaining portion 101, a contact portion 102 extending forward from one end of the retaining portion 101 and partially exposed from the tongue 92, and a soldering portion 103 extending backward out of the body 9 from another end of the retaining portion 101. A front end of the contact portion 102 is generally provided with a guide portion 104. The guide portion 104 bends forward and is used for guiding a mating connector (not shown) to perform insertion. However, the setting of the guide portion 104 increases the entire length of the conducting terminal 10, and moreover, during signal transmission, a signal is easily diffused outward from the guide portion 104, thereby increasing signal transmission loss, and reducing signal transmission quality of the electrical connector.

To solve the foregoing problem existing in the electrical connector, and improve the signal transmission quality of the electrical connector, a general choice is to remove the guide portion 104 of the foregoing conducting terminal 10. However, after the guide portion 104 of the conducting terminal 10 is removed, during frequent insertion, because of loss of a role which the guide portion 104 plays of guiding the mating connector, the contact portion 102 easily bends, thereby damaging the conducting terminal 10.

Therefore, a heretofore unaddressed need exists in the art to address the aforementioned deficiencies and inadequacies.

SUMMARY OF THE INVENTION

In one aspect, the present invention is directed to an electrical connector that presses against a terminal using a mating connector, thereby improving signal transmission quality.

In one embodiment, an electrical connector for mating with a mating connector includes an insulating body and multiple terminals. The insulating body has a base and a tongue protruding forward from the base. The insulating body is provided with multiple terminal slots, and the multiple terminal slots run from the tongue backward through the base. The terminals are disposed in the terminal slots. Each of the terminals has a retaining portion retained at the base, a contact portion extending forward from one end of the retaining portion to the tongue, and an urging portion disposed between the retaining portion and the contact portion. The urging portion is higher than an upper surface of the tongue. When the electrical connector mates with the mating connector, the mating connector presses against the urging portion downward, so that the contact portion electrically contacts the mating connector.

In one embodiment, before the electrical connector mates with the mating connector, the contact portion is located in the terminal slot.

In one embodiment, when the electrical connector mates with the mating connector, the contact portion is exposed from a lower surface of the tongue.

In one embodiment, the terminal slot vertically runs through the tongue corresponding to a position of the urging portion.

In one embodiment, a stopping portion is disposed above the terminal slot corresponding to the contact portion.

In one embodiment, the electrical connector further includes an insulating block. The multiple terminals are arranged into a row, and the insulating block and the multiple terminals are integrally injection molded.

In another aspect, the present invention is directed to an electrical connector. In one embodiment, an electrical connector for mating with a mating connector includes an insulating body and multiple terminals. The insulating body has a base and a tongue protruding forward from the base. The insulating body is provided with multiple terminal slots, and the multiple terminal slots run from the tongue backward through the base. The multiple terminals are disposed in the multiple terminal slots. Each of the terminals has a retaining portion retained at the base, a contact portion extending forward from one end of the retaining portion to the tongue, and an urging portion disposed between the retaining portion and the contact portion. The urging portion extends out of the tongue. When the electrical connector mates with the mating connector, the mating connector presses against the urging portion, so that the contact portion is exposed from the tongue and electrically contacts the mating connector.

In one embodiment, before the electrical connector mates with the mating connector, the contact portion is located in the terminal slot.

In one embodiment, a stopping portion is disposed at a position of the terminal slot corresponding to the contact portion.

In one embodiment, the terminal slot runs through the tongue corresponding to a position of the urging portion.

In a further aspect, the present invention is directed to an electrical connector. In one embodiment, an electrical connector for mating with a mating connector includes an insulating body and multiple terminals disposed in the insulating body. Each of the terminals has an urging portion and a contact portion extending forward from the urging portion. The mating connector includes an insulating case, and the insulating case has a mating portion. Multiple conducting terminals are disposed at the insulating case. When the electrical connector mates with the mating connector, the mating portion presses against the urging portion downward, so that the contact portion electrically contacts the conducting terminal.

In one embodiment, the insulating body has a base and a tongue protruding forward from the base, the insulating body is provided with multiple terminal slots, the multiple terminal slots run from the tongue backward through the base, and the multiple terminals are correspondingly disposed at the multiple terminal slots.

In one embodiment, the urging portion is higher than an upper surface of the tongue, and the contact portion is located in the terminal slot.

In one embodiment, the terminal slot vertically runs through the tongue corresponding to a position of the urging portion.

In one embodiment, a stopping portion is disposed at a position of the terminal slot corresponding to the contact portion.

Compared with the related art, certain embodiments of the present invention have the following beneficial advantages.

The urging portion is higher than the upper surface of the tongue. When the electrical connector mates with the mating connector, the mating connector presses against the urging portion downward, so that the contact portion electrically contacts the mating connector. Thus, it is not required to additionally dispose a structure at the front end of the contact portion to guide insertion of the mating connector, and the length of the terminal is shortened, thereby reducing the signal transmission loss to improve the signal transmission quality of the electrical connector. Moreover, the mating connector presses against the urging portion, so that the contact portion electrically contacts the mating connector, thereby protecting the contact portion in the insertion process, and preventing the terminal from being damaged.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
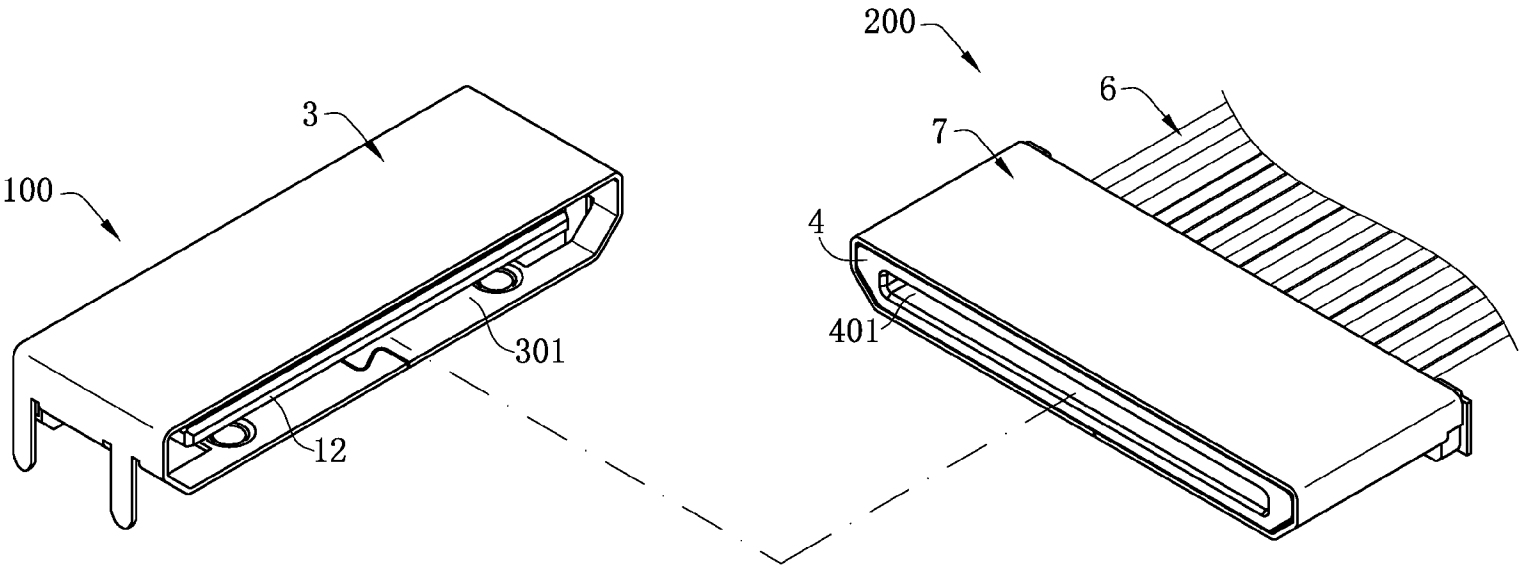
FIG. 1 is a three-dimensional assembly drawing of an electrical connector and a mating connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

Figure 5:
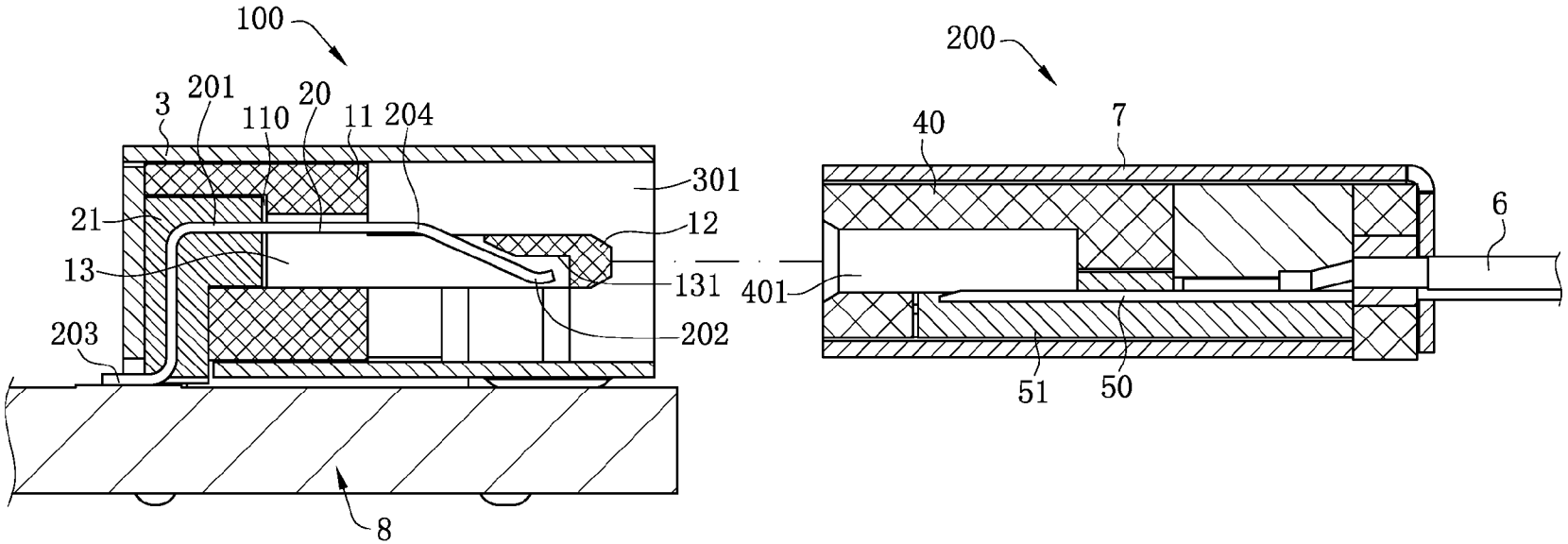
FIG. 5 is a sectional view obtained before the electrical connector butts the mating connector according to one embodiment of the present invention.

As shown in FIG. 1 and FIG. 5, an electrical connector 100 according to one embodiment of the present invention is used for being soldered to a circuit board 8 and is provided for a mating connector 200 to be inserted therein. The electrical connector 100 includes an insulating body 1, a first terminal module 2 disposed in the insulating body 1, and a shielding shell 3. The shielding shell 3 frames the insulating body 1 to form an insertion space 301 for the mating connector 200 to be inserted therein.

Figure 2:
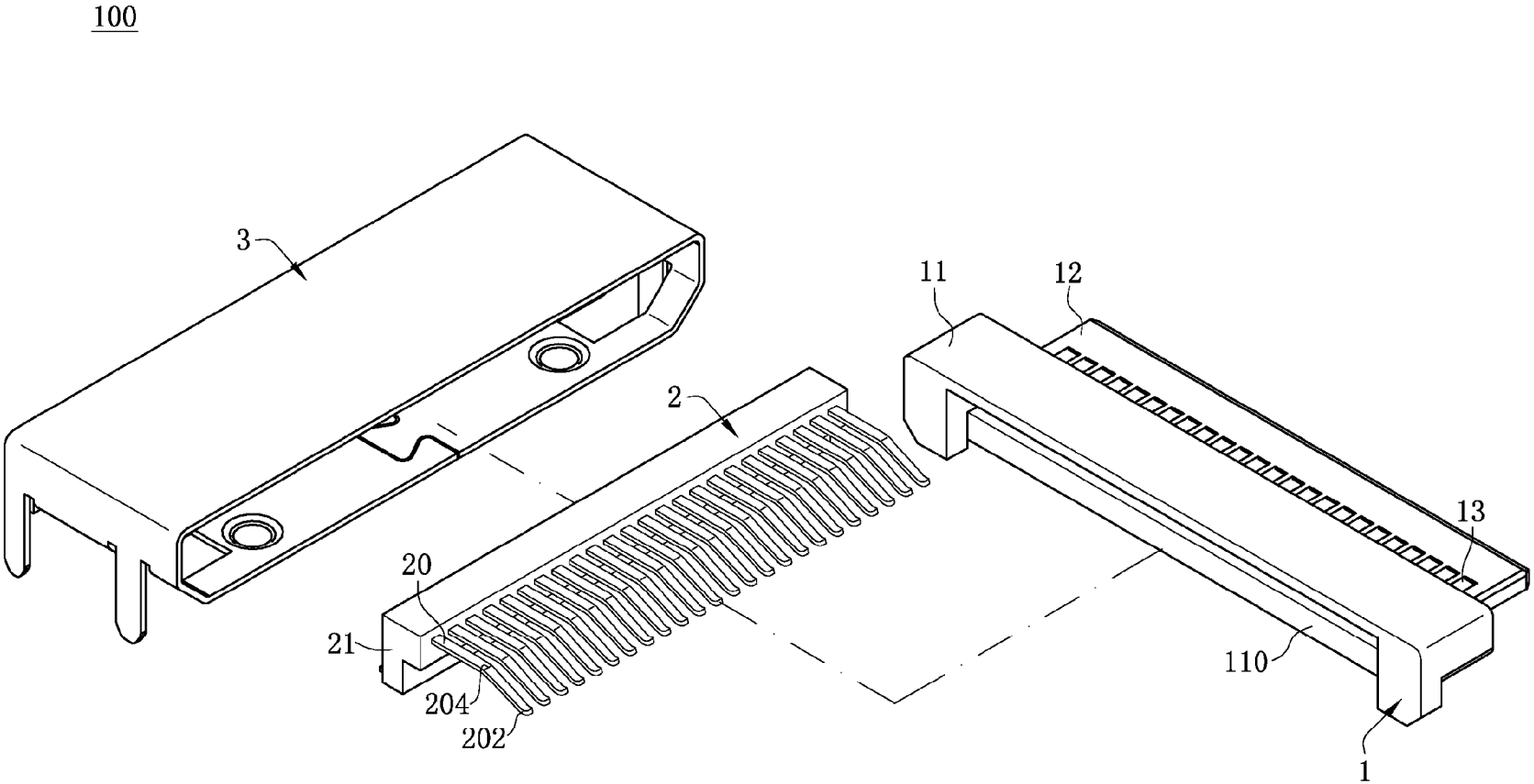
FIG. 2 is a three-dimensional exploded view of the electrical connector according to one embodiment of the present invention.
Figure 3:
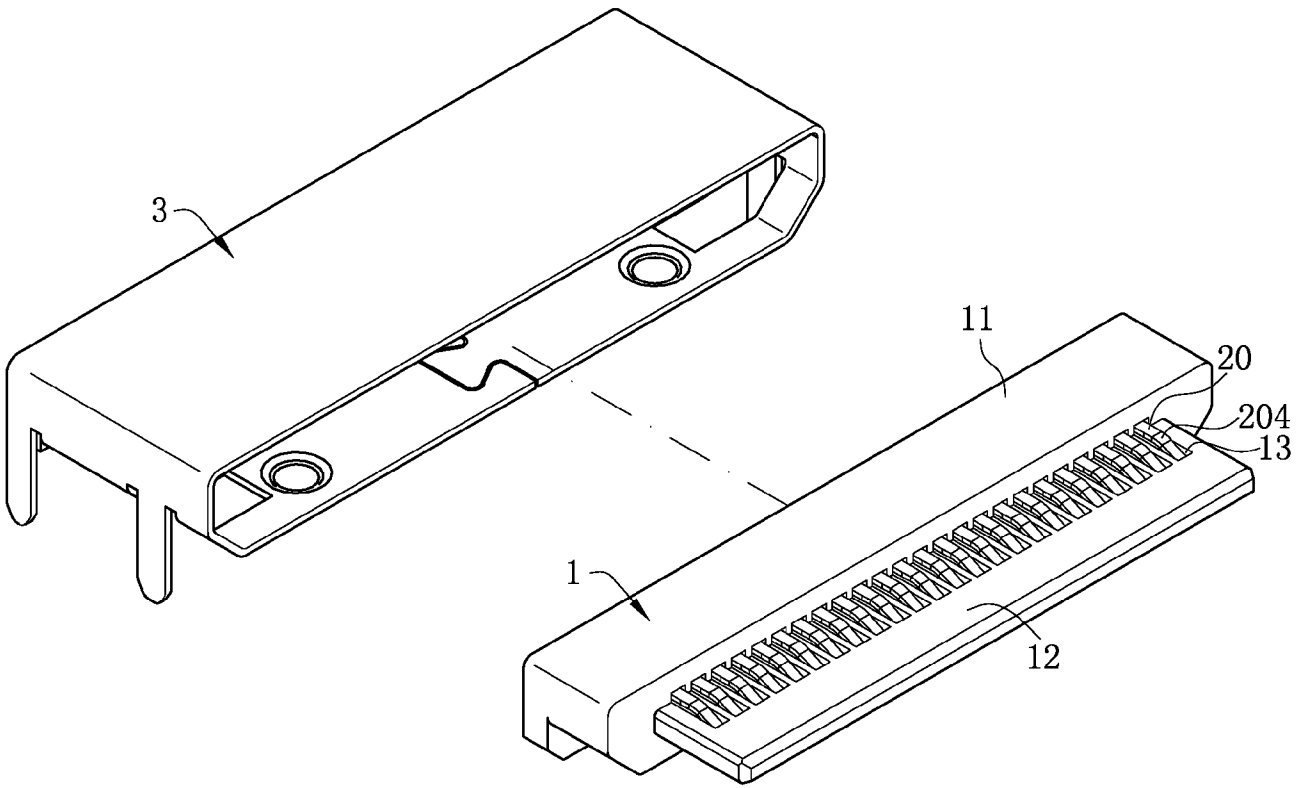
FIG. 3 is a partial three-dimensional exploded view of the electrical connector according to one embodiment of the present invention.

As shown in FIG. 2, FIG. 3 and FIG. 5, the insulating body 1 includes a base 11, and a tongue 12 protruding forward from the base 11. A row of terminal slots 13 is disposed on the insulating body 1, and the terminal slot 13 runs through the base 11 backward from the tongue 12. The first terminal module 2 includes multiple terminals 20 and an insulating block 21. The insulating block 21 and the multiple terminals 20 are integrally injection molded (insert molding). The multiple terminals 20 are arranged into a row and correspondingly inserted into the terminal slots 13. Each of the terminals 20 has a retaining portion 201, a contact portion 202 extending forward from one end of the retaining portion 201 to the tongue 12, and a soldering portion 203 extending backward out of the insulating body 1 from another end of the retaining portion 201. The contact portion 202 is used for electrically contacting a conducting terminal 50 of the mating connector 200, and the soldering portion 203 is soldered to the circuit board 8. Further, an urging portion 204 is disposed between the contact portion 202 and the retaining portion 201. The urging portion 204 is higher than an upper surface of the tongue 12, and the contact portion 202 is located in the terminal slot 13, so that the contact portion 202 is protected from external environmental pollution. Furthermore, the terminal slot 13 vertically runs through the tongue 12 corresponding to a position of the urging portion 204, which helps the electrical connector 100 perform heat dissipation. In addition, a stopping portion 131 is disposed above the terminal slot 13 corresponding to the contact portion 202, and is used for stopping the contact portion 202 from warping upward. Additionally, an accommodating space 110 used for accommodating the insulating block 21 is disposed at a back end of the base 11, and the first terminal module 2 is inserted into the insulating body 1 from back to front.

Figure 4:
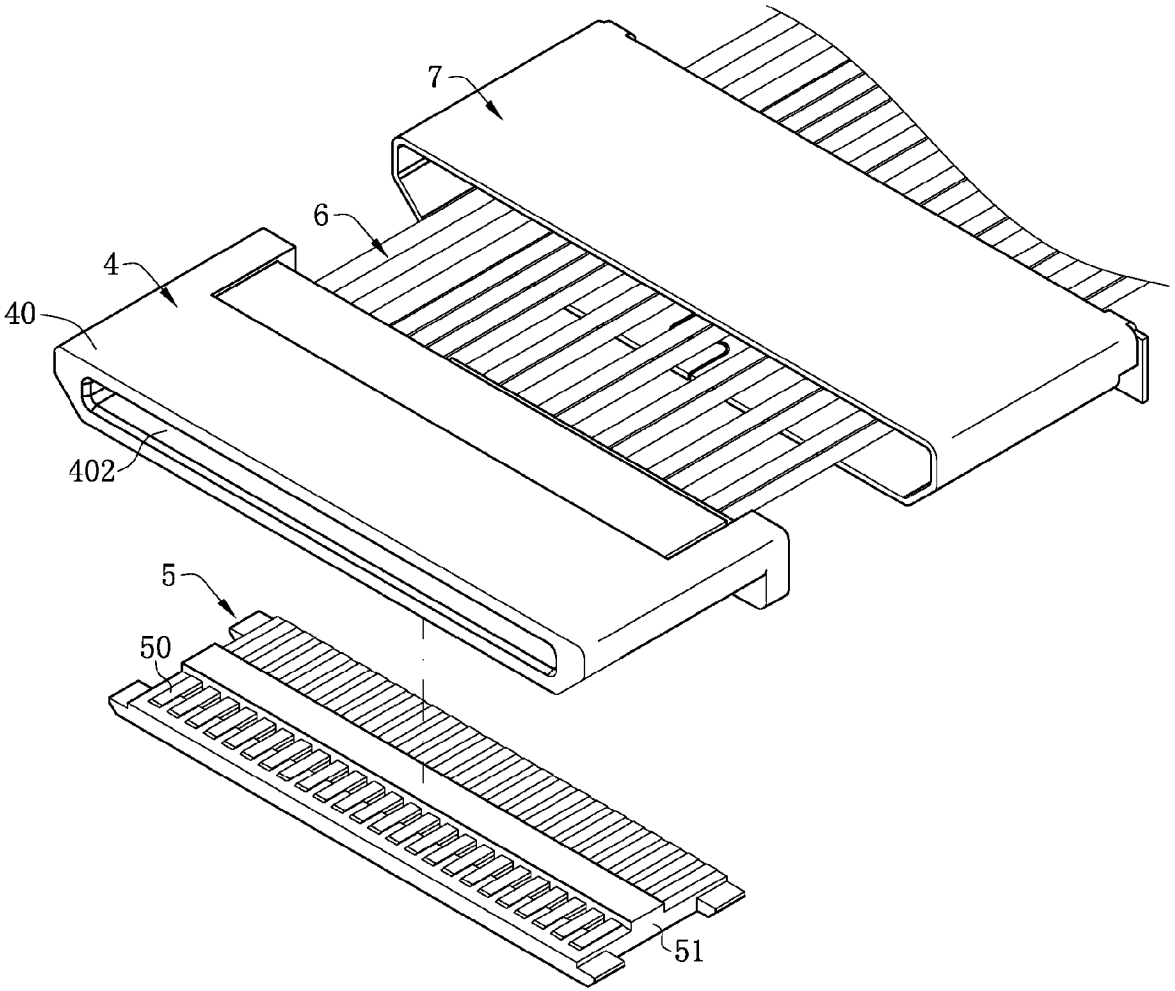
FIG. 4 is a three-dimensional exploded view of the mating connector according to one embodiment of the present invention.
Figure 6:
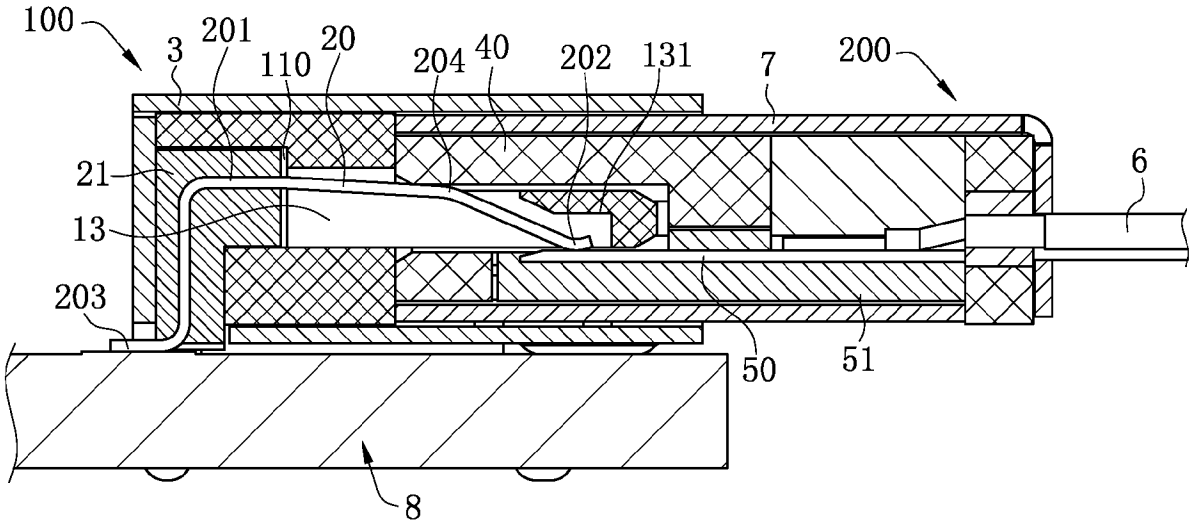
FIG. 6 is a sectional view obtained after the electrical connector butts the mating connector according to one embodiment of the present invention.
Figure 7:
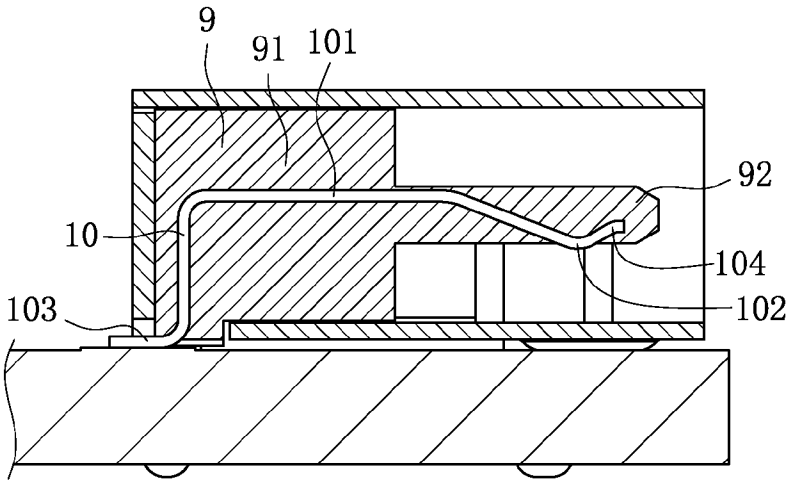
FIG. 7 Prior Art
FIG. 7 is a sectional view of an electrical connector in the prior art.

As shown in FIG. 4, FIG. 5 and FIG. 6, the mating connector 200 includes an insulating case 4. The insulating case 4 has a mating portion 40. A mating cavity 401 is depressed backward from a front end of the mating portion 40, and is used for receiving the tongue 12. A notch 402 is disposed at the bottom of the mating portion 40. A second terminal module 5 formed by integrally injection molding (insert molding) multiple conducting terminals 50 arranged into a row and a plastic block 51. The second terminal module 5 is disposed at the notch 402 to form a bottom wall of the mating portion 40, and the conducting terminals 50 are partially exposed from the mating cavity 401. A cable 6 is electrically connected to the conducting terminals 50. A metal case 7 covers the insulating case 4.

As shown in FIG. 5 and FIG. 6, before the mating connector 200 mates with the electrical connector 100, the contact portion 202 is located in the terminal slot 13, and the urging portion 204 is higher than the upper surface of the tongue 12. When the mating connector 200 mates with the electrical connector 100, the top wall of the mating portion 40 presses against the urging portion 204 downward, so that the contact portion 202 is exposed from the lower surface of the tongue 12 and electrically contacts the conducting terminal 50.

In summary, the electrical connector according to certain embodiments of the present invention, among other things, has the following beneficial advantages.

(1) The urging portion 204 is higher than the upper surface of the tongue 12. When the electrical connector mates with the mating connector 200, the top wall of the mating portion 40 presses against the urging portion 204 downward, so that the contact portion 202 electrically contacts the conducting terminal 50. Thus, it is not required to additionally dispose a structure at the front end of the contact portion 202 to guide insertion of the mating connector 200, and the length of the terminal 20 is shortened, thereby reducing the signal transmission loss to improve the signal transmission quality of the electrical connector 100. Moreover, the mating portion 40 presses against the urging portion 204, so that the contact portion 202 electrically contacts the conducting terminal 50, thereby protecting the contact portion 202 in the insertion process, and preventing the terminal 20 from being damaged.

(2) The contact portion 202 is located in the terminal slot 13, so that the contact portion 202 is prevented from external environmental pollution.

(3) The terminal slot 13 vertically runs through the tongue 12 corresponding to the position of the urging portion 204, which helps the electrical connector 100 perform heat dissipation.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for mating with a mating connector, comprising:

an insulating body having a base, a tongue protruding forward from the base, and a plurality of terminal slots run from the tongue backward and through the base; and a plurality of terminals disposed in the plurality of terminal slots respectively, wherein each of the terminals has a retaining portion retained at the base, a contact portion extending forward from one end of the retaining portion to the tongue, and an urging portion disposed between the retaining portion and the contact portion, the urging portion is higher than an upper surface of the tongue; and wherein when the electrical connector mates with the mating connector, the mating connector presses against the urging portion downward, such that the contact portion electrically contacts the mating connector.

2. The electrical connector of claim 1, wherein before the electrical connector mates with the mating connector, the contact portion is located in the terminal slot.

3. The electrical connector of claim 1, wherein when the electrical connector mates with the mating connector, the contact portion is exposed from a lower surface of the tongue.

4. The electrical connector of claim 1, wherein the terminal slot vertically runs through the tongue corresponding to a position of the urging portion.

5. The electrical connector of claim 1, wherein a stopping portion is disposed above the terminal slot corresponding to the contact portion.

6. The electrical connector of claim 1, further comprising an insulating block, wherein the terminals are arranged into a row, and the insulating block and the terminals are integrally injection molded.

7. An electrical connector for mating with a mating connector, comprising:

an insulating body having a base, a tongue protruding forward from the base, and a plurality of terminal slots run from the tongue backward and through the base; and a plurality of terminals disposed in the plurality of terminal slots respectively, wherein each of the terminals has a retaining portion retained at the base, a contact portion extending forward from one end of the retaining portion to the tongue, and an urging portion disposed between the retaining portion and the contact portion, and the urging portion extends out of the tongue; and wherein when the electrical connector mates with the mating connector, the mating connector presses against the urging portion, such that the contact portion is exposed from the tongue and electrically contacts the mating connector.

8. The electrical connector of claim 7, wherein before the electrical connector mates with the mating connector, the contact portion is located in the terminal slot.

9. The electrical connector of claim 7, wherein a stopping portion is disposed at a position of the terminal slot corresponding to the contact portion.

10. The electrical connector of claim 7, wherein the terminal slot runs through the tongue corresponding to a position of the urging portion.

11. An electrical connector for mating with a mating connector, comprising:

an insulating body; and a plurality of terminals disposed in the insulating body, wherein each of the terminals has an urging portion and a contact portion extending forward from the urging portion;

wherein the mating connector comprises an insulating case, the insulating case has a mating portion, and a plurality of conducting terminals are disposed at the insulating case; and wherein when the electrical connector mates with the mating connector, the mating portion presses against the urging portion downward, such that the contact portion electrically contacts the conducting terminal.

12. The electrical connector of claim 11, wherein the insulating body has a base, a tongue protruding forward from the base, and a plurality of terminal slots, the plurality of terminal slots run from the tongue backward and through the base, and the terminals are respectively disposed in the terminal slots.

13. The electrical connector of claim 12, wherein the urging portion is higher than an upper surface of the tongue, and the contact portion is located in the terminal slot.

14. The electrical connector of claim 12, wherein the terminal slot vertically runs through the tongue corresponding to a position of the urging portion.

15. The electrical connector of claim 12, wherein a stopping portion is disposed at a position of the terminal slot corresponding to the contact portion.

* * * * *